US011850861B2

(12) United States Patent
Praharaj et al.

(10) Patent No.: US 11,850,861 B2
(45) Date of Patent: Dec. 26, 2023

(54) SYSTEM AND METHOD FOR DETECTING AND REMEDIATING SPLIT INKJETS IN AN INKJET PRINTER DURING PRINTING OPERATIONS

(71) Applicant: Xerox Corporation, Norwalk, CT (US)

(72) Inventors: Seemit Praharaj, Webster, NY (US); Thomas J. Wyble, Williamson, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 39 days.

(21) Appl. No.: 17/328,463

(22) Filed: May 24, 2021

(65) Prior Publication Data

US 2022/0371348 A1 Nov. 24, 2022

(51) Int. Cl.
*B41J 2/165* (2006.01)

(52) U.S. Cl.
CPC ..... *B41J 2/16579* (2013.01); *B41J 2/16526* (2013.01)

(58) Field of Classification Search
CPC ..... B41J 2/0451; B41J 2/16579
See application file for complete search history.

(56) References Cited

U.S. PATENT DOCUMENTS

| | | | |
|---|---|---|---|
| 8,042,899 | B2 | 10/2011 | Folkins et al. |
| 8,300,266 | B2 | 10/2012 | Yeh et al. |
| 9,016,816 | B2 | 4/2015 | Terayama et al. |
| 10,220,614 | B1 | 3/2019 | Darling et al. |
| 10,500,849 | B1 | 12/2019 | Ernst et al. |
| 2006/0012624 | A1 | 1/2006 | Vanhooydonck |
| 2017/0259560 | A1 | 9/2017 | Sreenivasan et al. |
| 2018/0162134 | A1* | 6/2018 | Geissler ..... B41J 2/2142 |
| 2020/0346454 | A1 | 11/2020 | Krause et al. |

FOREIGN PATENT DOCUMENTS

DE 102014108342 A1 * 12/2015 ..... B41J 2/16579

* cited by examiner

*Primary Examiner* — Julian D Huffman
(74) *Attorney, Agent, or Firm* — Maginot Moore & Beck LLP

(57) ABSTRACT

A method analyzes image data of a test pattern printed on an image receiving member by a printer to identify split inkjets in the printheads of the printer. The test pattern is formed by operating each inkjet of a printhead to form a dash and the areas of the dashes are compared to an average dash area to identify split inkjets. Firing signal parameters for the split inkjets are adjusted and subsequent firing signals are generated using the adjusted parameters. Image data of the pixels formed by the split inkjets are analyzed after the split inkjets have been operated using the adjusted firing signal parameters. If the pixel size for a split inkjets indicates that the split inkjet has been remediated, then the firing signal parameters are returned to their nominal values.

20 Claims, 8 Drawing Sheets

SYSTEM AND METHOD FOR DETECTING AND REMEDIATING SPLIT INKJETS IN AN INKJET PRINTER DURING PRINTING OPERATIONS

TECHNICAL FIELD

This disclosure relates generally to the identification of split inkjets in an inkjet printer having one or more printheads, and, more particularly, to the remediation of those inkjets during printing operations.

BACKGROUND

Inkjet printers have printheads that operate a plurality of inkjets that eject liquid ink onto an image receiving member. The ink may be aqueous ink, ink emulsions, gel inks, or inks that are loaded in a solid form and then melted to produce liquid ink. A typical inkjet printer uses one or more printheads. Each printhead typically contains an array of individual nozzles for ejecting drops of ink across an open gap to an image receiving member to form an ink image. The image receiving member may be a continuous web of recording media, a series of media sheets, or a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled chamber in response to an electrical voltage signal, sometimes called a firing signal. The magnitude, or voltage level, of the signal affects the amount of ink ejected in each drop. The firing signal is generated by a printhead controller in accordance with image data. An inkjet printer forms a printed image using image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member using image data to produce an ink image that corresponds to the image data.

One issue that arises from the operation of the inkjets in the printheads to form ink images is called "split inkjets." Split inkjets, as that term is used in this document, means inkjets that produce a group of ink drop fragments rather than a single ink drop when the inkjet is operated to eject an ink drop. These ink fragments, sometimes called satellites, tend to spread and produce a splotchy pixel rather than a well-defined circle. These defective pixels can result in streaks that are adverse to the final image quality perceived by the customer.

A procedure called "purging" is an effective procedure to overcome any deterioration in inkjet performance. To purge a printhead, pressurized air is applied to the ink reservoir in the printhead to expel ink through the inkjets. The expelled ink collects on the faceplate of the printhead and is typically wiped into waste ink reservoirs. While this procedure restores many inkjets to their operational status, it extracts a heavy toll because productivity is lost since the printing operation needs to be brought to a complete halt in order to purge the printheads and because the cost of the expelled ink can be high especially when purging is performed frequently. Consequently, purging is generally limited to once every two hours of printer operation.

Unfortunately, inkjet degradation can occur at time scales significantly shorter than the two hours typically separating purge operations for a printer. Depending on the area coverage of the prints being made, the defects may appear as soon as ten minutes, which corresponds to about 2500 sheets being printed, after a purge operation. Techniques have been developed for camouflaging missing or weak inkjets. Missing inkjets eject practically no ink and weak inkjets eject a small portion of a full-sized ink drop. By increasing the amount of ink in ink drops ejected by other inkjets in the vicinity of a missing or weak inkjet, the effect of the missing or weak inkjet can be reduced to some degree. These techniques, however, are not effective for addressing split inkjets since these inkjets spread the amount of an ink drop in the area that is larger than where the drop should land. Adding more ink to the area is as likely to cause image defects as it is to cure them. Being able to detect split inkjets during printing operations and remediate them to some degree without halting printing operations would be beneficial.

SUMMARY

A method of operating a printer analyzes image data corresponding to a test pattern generated on an image receiving member by a printer to identify split inkjets and then generates remedial firing signals for the identified split inkjets for a limited time. The method includes operating at least one printhead to form a test pattern on an image receiving member, generating image data of the test pattern on the image receiving member, and analyzing the generated image data to identify split inkjets in the at least one printhead.

A new printer analyzes image data corresponding to a test pattern generated on an image receiving member by the printer to identify split inkjets and then generates remedial firing signals for the identified split inkjets for a limited time. The printer includes at least one printhead, and a controller configured to operate the at least one printhead to form a test pattern on an image receiving member in the inkjet printer, generate image data of the test pattern on the image receiving member, and analyze the generated image data to identify split inkjets in the at least one printhead.

BRIEF DESCRIPTION OF THE DRAWINGS

The foregoing aspects and other features of a printer and its method of operation that detects and remediates split inkjets during printing operations are explained in the following description, taken in connection with the accompanying drawings.

DETAILED DESCRIPTION

Figure 1:
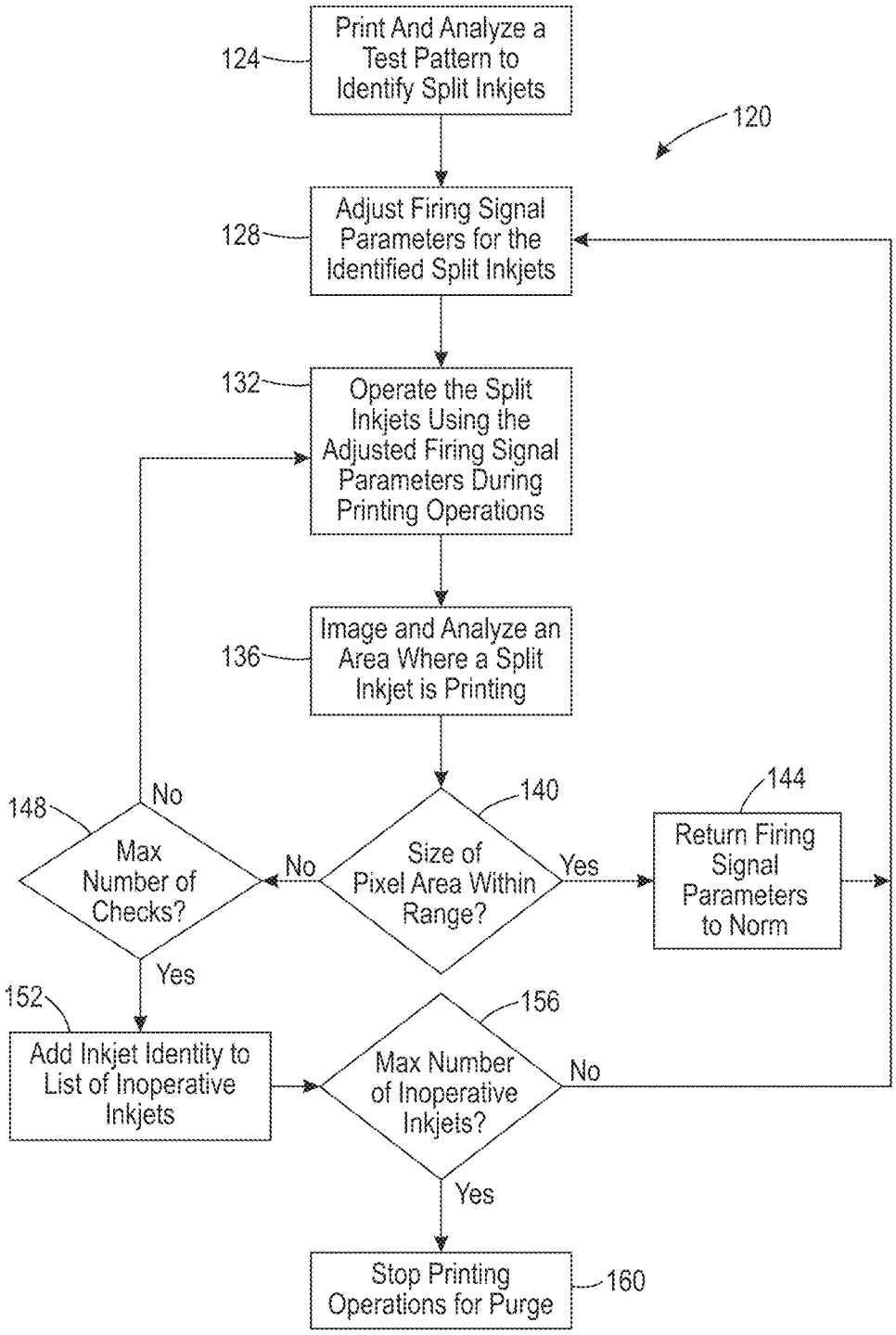
FIG. 1 is a flow diagram of a method for identifying and remediating split inkjets in an inkjet printer.

A process 120 for detecting split inkjets and remediating them to operational status is depicted in FIG. 1. Process 120 employs an optical sensor to analyze image data obtained from the surface of an image receiving member in a print system. This analysis enables the positions and areas of the dashes to be determined more accurately and the positional and area information for the dashes are used to determine which inkjets in the printheads are split inkjets. In one embodiment, the optical sensor includes an array of optical detectors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is higher than the magnitude of a signal generated in response to light reflected from a drop of ink on the image receiving member. The differences in the magnitudes of the generated signals are used to identify the ink drops on an image receiving member, such as a paper sheet, media web, or print drum. The reader should note, however, that lighter colored inks, such as yellow, cause optical detectors to generate lower contrast signals with reference to uncovered portions of the image receiving member than the contrast signals produced by darker colored inks, such as black, with reference to uncovered portions of the image receiving member. Thus, the contrast signal differences are used to differentiate between dashes of different colors. The magnitudes of the electrical signals generated by the optical detectors are converted to digital values by an appropriate analog-to-digital converter. These digital values are denoted as image data in this document and these data are analyzed to identify positional information about the dashes on the image receiving member and the inkjets that produced the dashes.

As used in this document, the term "analyze" or "analysis" means using a controller to process image data to determine whether the inkjets operated to eject ink did, in fact, eject ink, where the ejected ink landed, and the areas of the image receiving surface that did not receive ink. In some printing systems, an image of a printed image is generated by printing the printed image onto media or by transferring the printed image onto media, ejecting the media from the system, and then scanning the image with a flatbed scanner or other known offline imaging device. This method of generating a picture of the printed image suffers from the inability to analyze the printed image in situ and from the inaccuracies imposed by the external scanner. In some printers, a scanner is integrated into the printer and positioned at a location in the printer that enables an image of an ink image to be generated while the image is on media within the printer or while the ink image is on the rotating image member. These integrated scanners typically include one or more illumination sources and a plurality of optical detectors that receive radiation from the illumination source that has been reflected from the image receiving surface. The radiation from the illumination source is usually visible light, but the radiation may be at or beyond either end of the visible light spectrum. If light is reflected by a white surface, the reflected light has the same spectrum as the illuminating light. In some systems, ink on the imaging surface may absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the intensity of the reflected light received by the detector. The electrical signals from the optical detectors may be converted to digital signals by analog-to-digital converters and provided as digital image data to an image processor. Analysis of printed images is performed with reference to two directions. "Process direction" refers to the direction in which the image receiving member is moving as the imaging surface passes the printhead to receive the ejected ink and "cross-process direction" refers to the direction across the width of the image receiving member.

The environment in which the image data are generated is not pristine. Several sources of noise exist and need to be addressed in the analysis of the image data. For example, the image receiving member can contribute noise to the image data. Specifically, structure in the image receiving surface and colored contaminants in the image receiving surface may be confused with the ink drops in the image data and lightly colored inks and weakly performing inkjets provide ink drops that contrast less starkly with the image receiving member than darkly colored inks or ink drops formed with an appropriate ink drop mass. Analysis of image data of printed images is useful for detecting drops ejected by split inkjets and for identifying which inkjets in a printhead are split inkjets.

Figure 2:
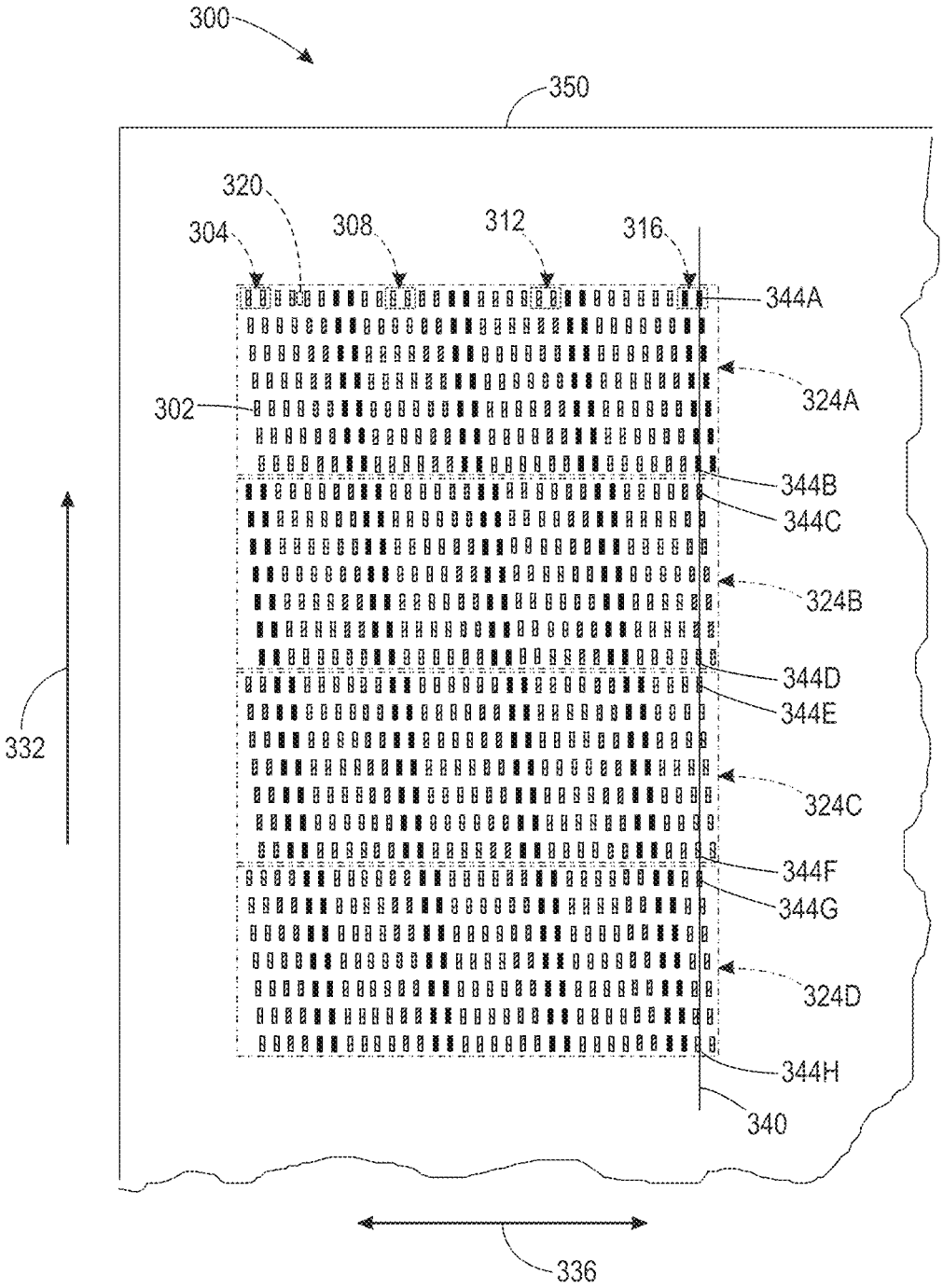
FIG. 2 is a sample test pattern suitable for use with the method of FIG. 1.

An example test pattern suitable for use with an image analyzing process, such as process 120, is depicted in FIG. 2. Test pattern 300 includes a plurality of dashes, where each dash is formed from ink ejected from a single inkjet ejector in a printhead. The dashes 302 are formed in the print process direction 332, with multiple rows of dashes disposed along the cross-process axis 336. Test pattern 300 is configured for use with a printer using cyan, magenta, yellow, and black (CMYK) coloring stations. Test pattern 300 is further configured for use with ink coloring stations configured for interlaced printing using two printhead arrays for each of the CMYK colors. Dashes of the same color, one from each of the aligned printheads in each coloring station, are spaced adjacent to one another in each row of test pattern 300, as seen with cyan dashes 304, magenta dashes 308, yellow dashes 312, and black dashes 316. In FIG. 2, the dashes in each row of test pattern 300 are arranged in a ladder including seven (7) inkjet ejectors, such that one inkjet ejector in the inkjet printhead forms a dash, and the next dash in the row comes from an inkjet ejector that is offset by six (6) positions in the cross-process axis 336. The space 320 between consecutive dashes in a row of test pattern 300 is the width of the six non-printing inkjet ejectors. Alternative test patterns could employ ladders with a larger or smaller number of inkjet ejectors in each group producing a similar test pattern having multiple rows of dashes.

The length of the dashes 302 corresponds to the number of drops used to form a dash. The number of drops is chosen to produce a dash that is sufficiently greater in length than the resolution of an optical detector in the process direction. The distance imaged by an optical detector is dependent upon the speed of the image member moving past the detector and the line rate of the optical detector. A single row of optical detectors extending across the width of the imaging area on the image receiving member is called a scanline in this document. The dashes are generated with a length that is greater than a single scanline in the process direction so the dash image can be resolved in the image processing. Thus, multiple scanlines are required to image the entire length of the dashes in the process direction.

Rows in test pattern 300 are grouped according to the ladder formation used to space dashes 302, as seen by groups 324A-324D. Each row in one of groups 324A-324D is offset by one inkjet ejector in the cross-process axis 336 from the preceding row. Each group has seven rows, allowing each inkjet ejector in a seven inkjet ejector series to form one dash. The number of groups is determined by the number of unique colors the printing system generates, with test pattern 300 showing an example for a CMYK printing system providing four groups, 324A, 324B, 324C, and 324D. The four groups 324A-324D allow each inkjet ejector in the printheads for every color (CMYK) to print a dash in test pattern 300. Thus, line 340 that is parallel to process direction 332 is aligned to pass through the center of a dash of each color in the same cross-process position. Line 340 passes through the center of black dash 344A, and passes by the edge of black dash 344B. In relative terms, black dash 344A is formed by an inkjet ejector in first black printhead at the first position of a group of seven consecutive inkjet ejectors in the first printhead. Dash 344B corresponds to the seventh and final inkjet ejector of a previous group from the second black printhead, where the second black printhead is offset in the cross-process axis 336 by one-half the width that separates ejectors in each printhead. This offset allows the two black printheads to interlace dashes for full coverage of all locations under the printheads in the print zone.

Line 340 passes through yellow dashes 344C and 344D, magenta dashes 344E and 344F, and cyan dashes 344G and 344H in a similar manner to black dashes 344A and 344B. When aligned in the cross process direction, drops of various colored inks are placed in the same location for color printing that produces secondary colors by mixing inks from the CMYK colors. Additionally, the interlaced arrangement of printheads enables side-by-side printing of ink drops to produce colors that extend the color gamut and hues available with the printer. The test pattern 300 of FIG. 2 can be repeated along the cross-process axis to include some or all of the inkjet ejectors from each printhead in a print zone used to form images on an image receiving member passing through the print zone.

Figure 6:
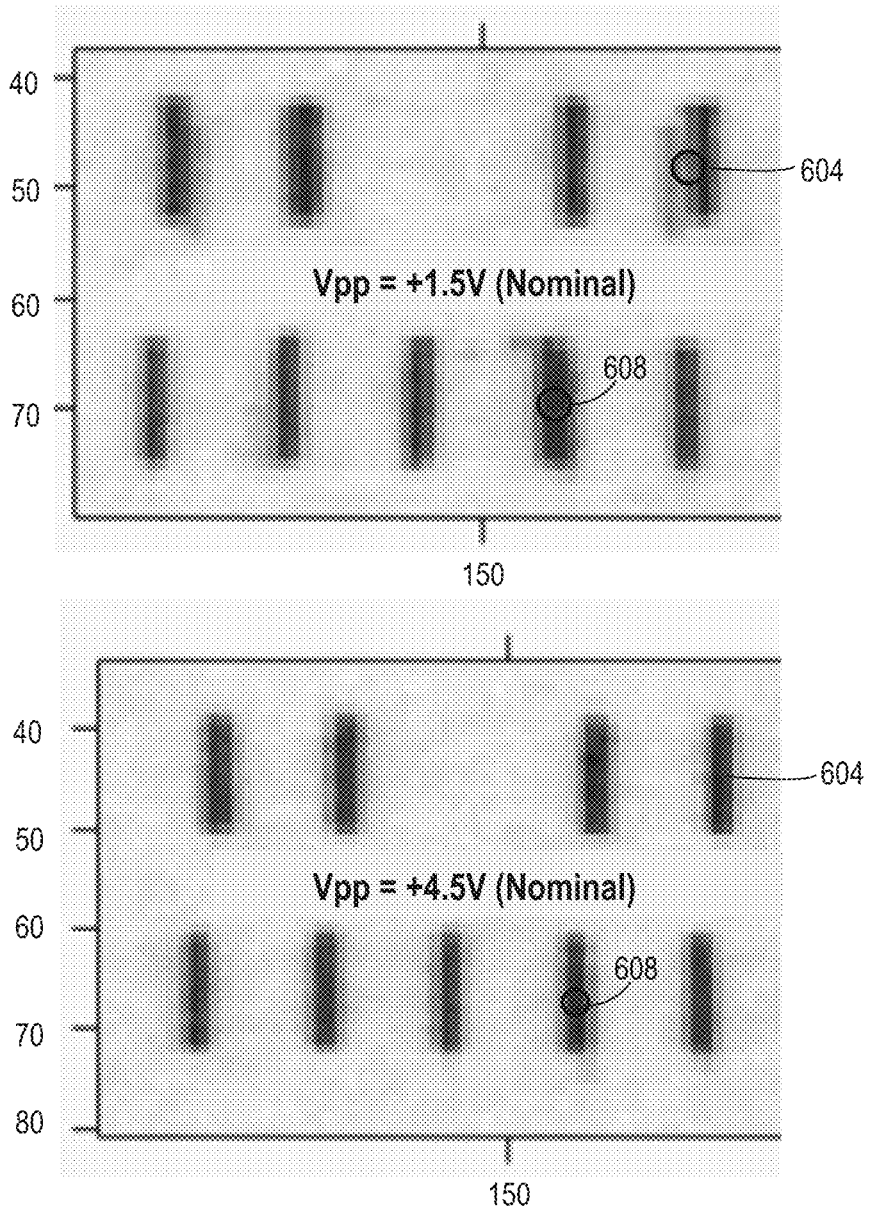
FIG. 6 is an image showing the remediation of a split inkjets using an elevated peak-to-peak firing signal voltage.

The process of 120 of FIG. 1 begins by printing the test pattern discussed above and determining which dashes were printed by split inkjets (block 124). The analysis for identifying split inkjets is discussed in more detail below. Once the split inkjets are identified, firing signal parameters are adjusted in a manner that remediates the inkjet. The firing signal parameters include the peak voltage of the signal, the frequency of the signal, as well as others known in the art. In one embodiment, the peak voltage of the firing signal for the split inkjet is increased. As shown in the upper image of FIG. 6, eight dashes have been formed using eight different inkjets. The size of the dash areas for dashes 604 and 608 indicate that the inkjets that formed this dashes are split inkjets. All of the inkjets forming the dashes in this figure were operated with a firing signal having a peak voltage of 1.5V. The inkjets that formed dashes 604 and 608 were subsequently operated with a peak voltage of 4.5V. As shown in the lower figure of FIG. 6, the dashes now formed by the same inkjets have approximately the same area as the other dashes formed by operating the other inkjets with a firing signal having a peak voltage of 1.5V.

The inkjets are operated during image printing using the adjusted firing signal parameters (block 132) and the image is analyzed in the areas corresponding to the split inkjets (block 136). If the pixel produced by the inkjet operated at the adjusted firing signal parameter is approximately the same size as a pixel formed by a normal inkjet (block 140), then the adjusted firing signal parameter is returned to its nominal value (block 144). As used in this document, the term "normal inkjet" means an inkjet that is not an inoperative, weak, or split inkjet. Also, as used in this document, the term "nominal value" means a default value used for a firing signal parameter. If the size of the pixel is not within a tolerance range about the size of a pixel printed by a normal inkjet, then the number of checks made on this inkjet is incremented by one and the number of checks is compared to a maximum threshold (block 148). If the maximum number of checks for the inkjet has not been reached, then the inkjet continues to be operated with the adjusted firing signal parameter and additional checks are made until the inkjet is either remediated or the maximum number of checks have been made. As used in this document, the term "remediated" means a split inkjet that has returned to normal inkjet status by the operation of the split inkjet using a firing signal generated with an adjusted firing signal parameter. If the maximum number of checks is reached for an inkjet, then an identifier for the split inkjet is stored in a list of inoperative inkjets (block 152). The number of inoperative inkjets in the list is then compared to a maximum number of inkjets permitted in a printhead (block 156). If the number is equal to the maximum number of inkjets, printing operations are halted so a purge can be conducted (block 160). If the maximum number of inoperative inkjets has not been reached, then the firing signal parameter for the inoperative inkjet is further adjusted (block 128) and the process continues. In this example, the peak voltage can be further increased to see if a higher peak voltage can remediate the split inkjet.

Figure 3:
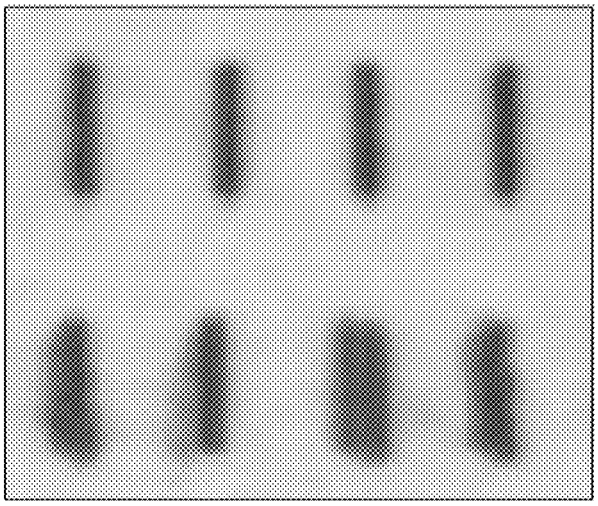
FIG. 3 is an image of dashes produced by split inkjets and dashes produced by operative inkjets.
Figure 4:
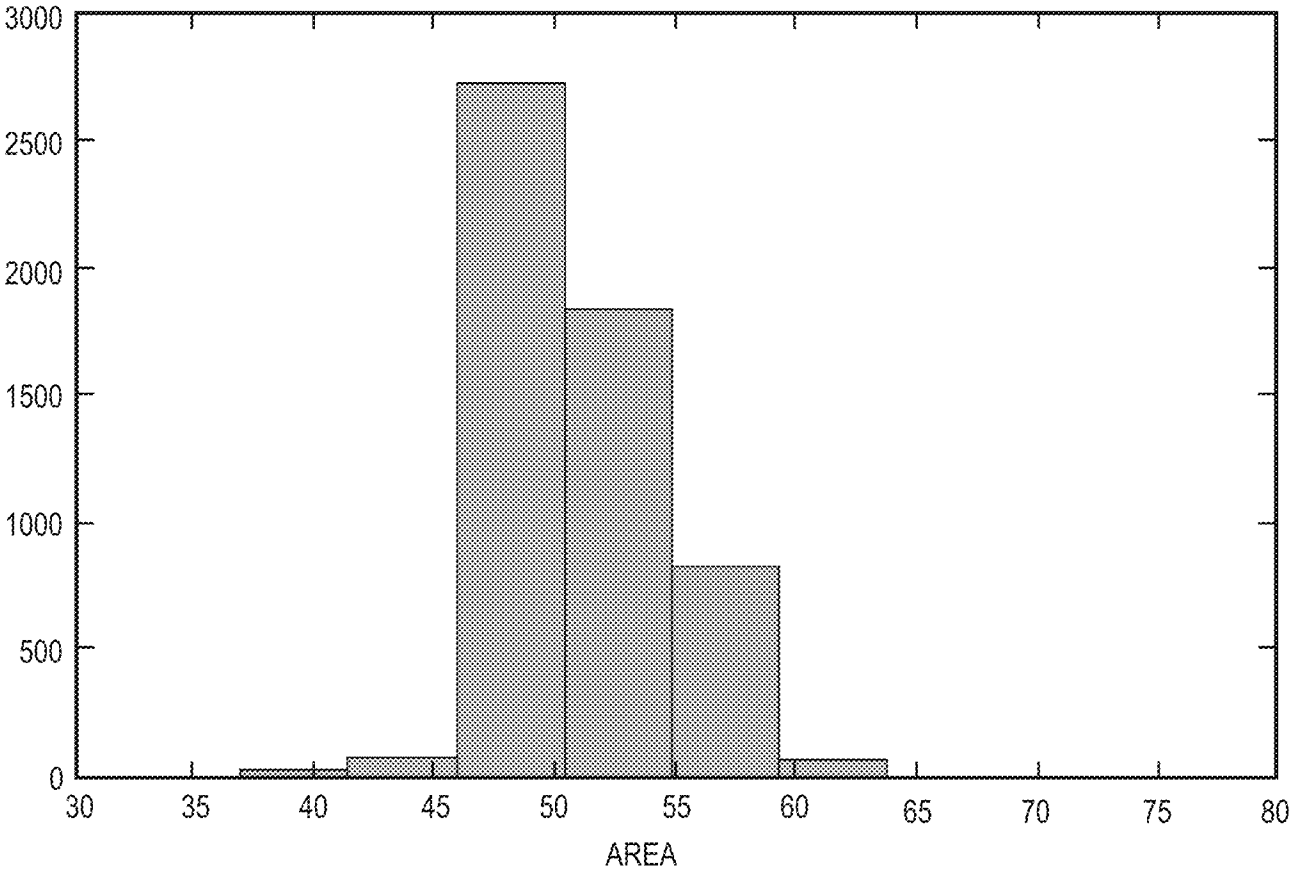
FIG. 4 depicts a histogram correlating a number of inkjets in a printer and the sizes of the areas of the dashes formed by the inkjets.
Figure 5:
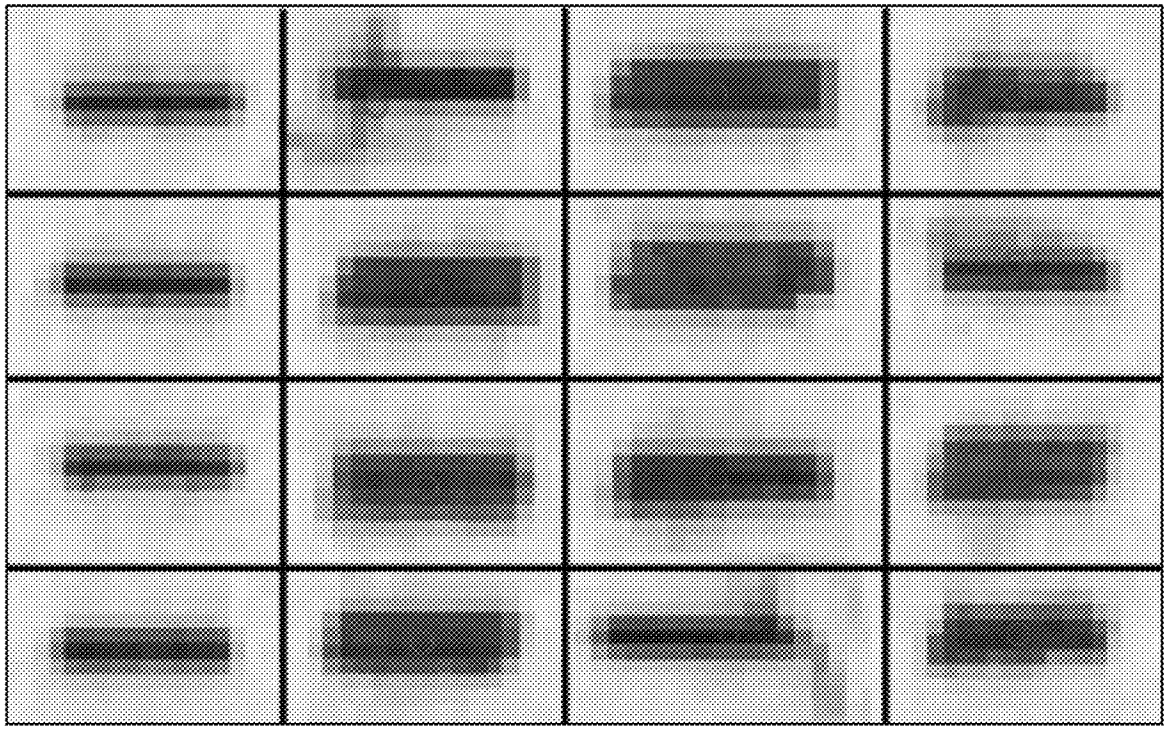
FIG. 5 is another image of dashes produced by split inkjets and dashes produced by operative inkjets.

FIG. 3 shows eight dashes that were formed by inkjets in a printhead. The upper row of dashes were formed by normal inkjets and the dashes in the lower row were formed by split inkjets. FIG. 5 is an enlarged view of dashes formed by inkjets in a printhead. The upper three rows of dashes are formed with split inkjets and the dashes in the bottom row are formed with normal inkjets. As can be clearly observed from the figures, the split inkjets produce dashes that have a larger area than the normal inkjets. FIG. 4 depicts a histogram of the sizes for the dash areas of 5,544 inkjets in a printhead. Approximately 4,500 of the inkjets produce dashes having an area that is 55 $mm^2$ or less, while approximately 800 inkjets form a dash having an area in a range of 55 $mm^2$ to 60 $mm^2$ and approximately 100 inkjets form a dash having an area greater than 60 $mm^2$. Analysis of this histogram reveals that dashes having an area that is 1.5 times the standard deviation of the average dash areas indicates an inkjet is a split inkjet. Thus, a distribution of the dash areas is determined empirically so the standard deviation can be identified and used to identify split inkjets.

Figure 7:
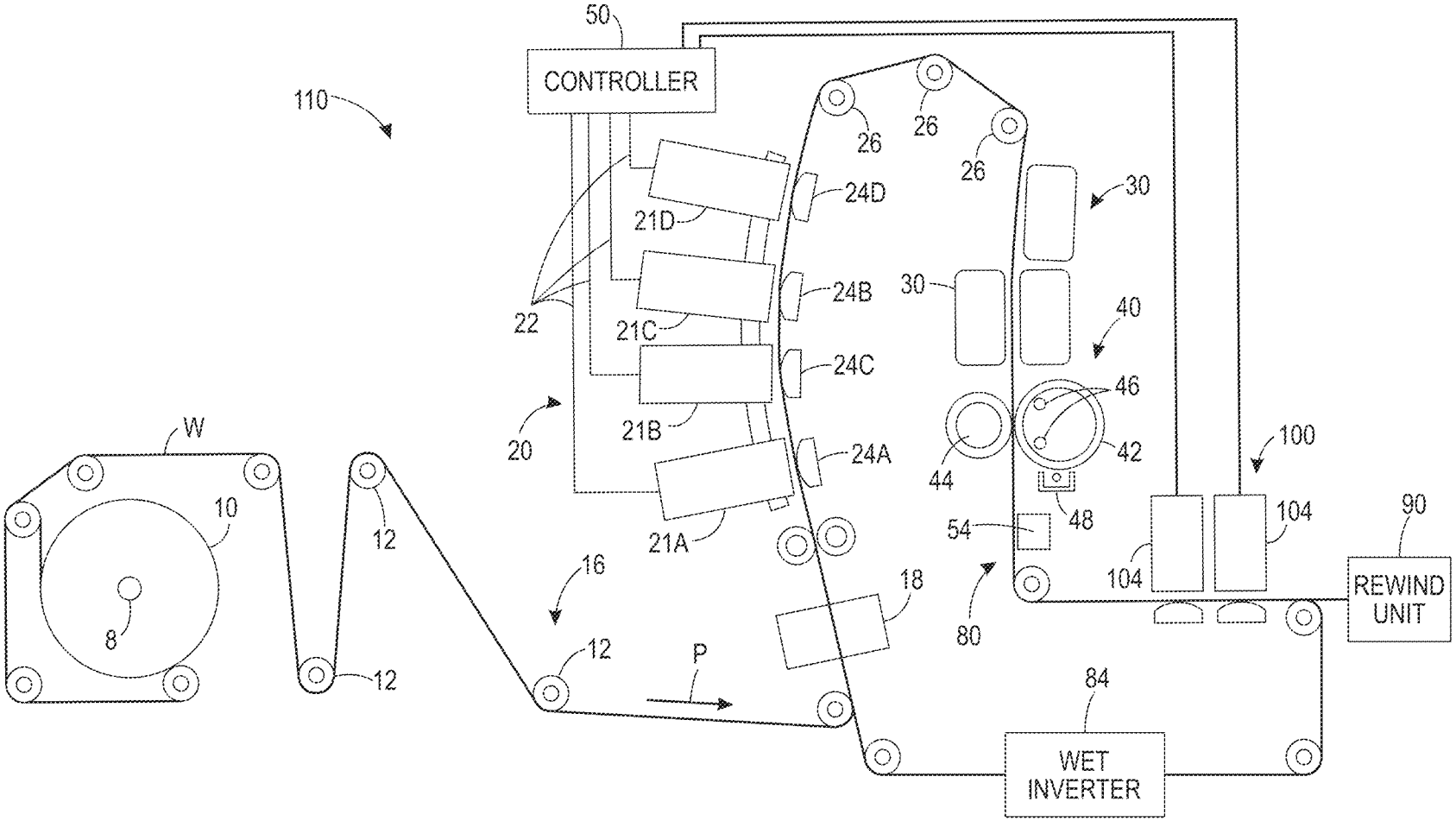
FIG. 7 PRIOR ART
FIG. 7 is a schematic view of a prior art inkjet imaging system that ejects ink onto a continuous web of media as the media moves past the printheads in the system.

Referring to FIG. 7, a prior art inkjet imaging system 110 is shown. The controller 50 of this system can be reconfigured with programmed instructions stored in a non-transitory computer readable media operatively connected to the controller so the controller performs the process of FIG. 1 when it executes the programmed instructions and operates the components of the printing system 110. For the purposes of this disclosure, the imaging apparatus is in the form of an inkjet printer that employs one or more inkjet printheads and an associated ink supply. However, the systems and methods described herein are applicable to any of a variety of other imaging apparatus that use inkjets to eject one or more colorants to a medium or media. The imaging apparatus includes a print engine to process the image data before generating the control signals for the inkjet ejectors. The colorant can be ink, or any suitable substance that includes one or more dyes or pigments and that are applied to the selected media. The colorant can be black, or any other desired color, and a given imaging apparatus can be capable of applying a plurality of distinct colorants to the media. The media includes any of a variety of substrates, including plain paper, coated paper, glossy paper, or transparencies, among others, and the media can be provided as sheets, rolls, or another physical formats.

FIG. 7 is a simplified schematic view of a direct-to-sheet, continuous-media, phase-change inkjet imaging system 110, that can be modified as noted previously to generate the test patterns and adjust the firing signal parameters for split inkjets using the method discussed above. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 100, and rewind unit 90. For duplex operations, the web inverter 84 is used to flip the web over to present a second side of the media to the printing station 20, printed web conditioner 80, and coating station 100 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 100 before being flipped by the inverter 84 and laterally displaced by a distance that enables the web to travel over the other half of the rollers opposite the printing station 20, printed web conditioner 80, and coating station 100 for the printing, conditioning, and coating, if necessary, of the reverse side of the web. The rewind unit 90 is configured to wind the web onto a roller for removal from the printer and subsequent processing.

The media is unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media is transported along the path in cut sheet form in which case the media supply and handling system includes any suitable device or structure that enables the transport of cut media sheets along a expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a printing station 20 that includes a series of printhead modules 21A, 21B, 21C, and 21D, each printhead module effectively extending across the width of the media and being able to place ink directly (i.e., without use of an intermediate or offset member) onto the moving media. As is generally familiar, each of the printheads can eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjet ejectors in the printheads to enable the four colors to be ejected with a reliable degree of accuracy for registration of the differently color patterns to form four primary-color images on the media. The inkjet ejectors actuated by the firing signals corresponds to image data processed by the controller 50. The image data can be transmitted to the printer, generated by a scanner (not shown) that is a component of the printer, or otherwise generated and delivered to the printer. In various possible embodiments, a printhead module for each primary color can include one or more printheads; multiple printheads in a module can be formed into a single row or multiple row array; printheads of a multiple row array can be staggered; a printhead can print more than one color; or the printheads or portions thereof can be mounted movably in a direction transverse to the process direction P, such as for spot-color applications and the like.

The printer can use "phase-change ink," by which is meant that the ink is substantially solid at room temperature and substantially liquid when heated to a phase change ink melting temperature for jetting onto the imaging receiving surface. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink can also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each printhead module is a backing member 24A-24D, typically in the form of a bar or roll, which is arranged substantially opposite the printhead on the back side of the media. Each backing member is used to position the media at a predetermined distance from the printhead opposite the backing member. Each backing member can be configured to emit thermal energy to heat the media to a predetermined temperature which, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices can be employed to maintain the media temperature within a predetermined range. For example, the air temperature and air flow rate behind and in front of the media also impact the media temperature. Accordingly, air blowers or fans can be utilized to facilitate control of the media temperature. Thus, the media temperature is kept substantially uniform for the jetting of all inks from the printheads of the printing station 20. Temperature sensors (not shown) can be positioned along this portion of the media path to enable regulation of the media temperature. These temperature data can also be used by systems for measuring or inferring (from the image data, for example) how much ink of a given primary color from a printhead is being applied to the media at a given time.

Following the printing zone 20 along the media path are one or more "mid-heaters" 30. A mid-heater 30 can use contact, radiant, conductive, or convective heat, or combinations of these different heaters, to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat or pressure or both to the media to fix the images to the media. The fixing assembly can include any suitable device or apparatus for fixing images to the media including heated or unheated pressure rollers, radiant heaters, heat lamps, and the like. In the embodiment of the FIG. 7, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 also improves image permanence by increasing ink layer cohesion and increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly can be configured to spread the ink using non-contact heating (without pressure) of the media after the print zone. Such a non-contact fixing assembly can use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 can also include a cleaning/oiling station 48 associated with image-side roller 42. The station 48 cleans and applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature as it is printed to enable spreading of the ink.

The coating station 100 applies a clear ink to the printed media. This clear ink helps protect the printed media from smearing or other environmental degradation following removal from the printer. The overlay of clear ink acts as a sacrificial layer of ink that can be smeared or offset during handling without affecting the appearance of the image underneath. The coating station 100 applies the clear ink with either a roller or a printhead 104 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating can be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink can be heated to about 100° C. to 140° C. to melt the solid ink for jetting onto the media.

Following passage through the spreader 40 the printed media is wound onto a roller for removal from the system (simplex printing) or directed to the web inverter 84 for inversion and displacement to another section of the rollers for a second pass by the printheads, mid-heaters, spreader, and coating station. The duplex printed material is then wound onto a roller for removal from the system by rewind unit 90. Alternatively, the media can be directed to other processing stations that perform tasks such as cutting, binding, collating, and stapling the media or the like.

Operation and control of the various subsystems, components and functions of the device 110 are performed with the aid of the controller 50. The controller 50 is implemented with general or specialized programmable processors that execute programmed instructions. The instructions and data required to perform the programmed functions are stored in non-transitory computer readable media associated with the processors or controllers. The processors, their memories, and interface circuitry configure the controllers and print engine to perform the functions described above. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The imaging system 110 includes an optical sensor 54. The drum sensor is configured to detect, for example, the presence, intensity, and location of ink drops jetted onto the receiving member by the inkjets of the printhead assembly. In one embodiment, the optical sensor includes a light source and a light detector. The light source can be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment includes three linear arrays, one for each of the colors red, green, and blue. Alternatively, all of the LEDS can be arranged in a single linear array in a repeating sequence of the three colors. The LEDs of the light source can be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array can be configured to translate across the image substrate. For example, the linear array can be mounted to a movable carriage that translates across image receiving member. Other devices for moving the light sensor can also be used.

A reflectance is detected by the light detector in optical sensor 54 that corresponds to each ink jet and to each pixel location on the receiving member. The light sensor is configured to generate electrical signals that correspond to the reflected light and these signals are provided to the controller 50. These electrical signals are used by the controller 50 to determine information pertaining to the ink drops ejected onto the receiving member as previously described. Using this information, the controller 50 makes adjustments to the firing signal parameters to alter the generation of firing signals to remediate a split inkjet as previously described.

Figure 8:
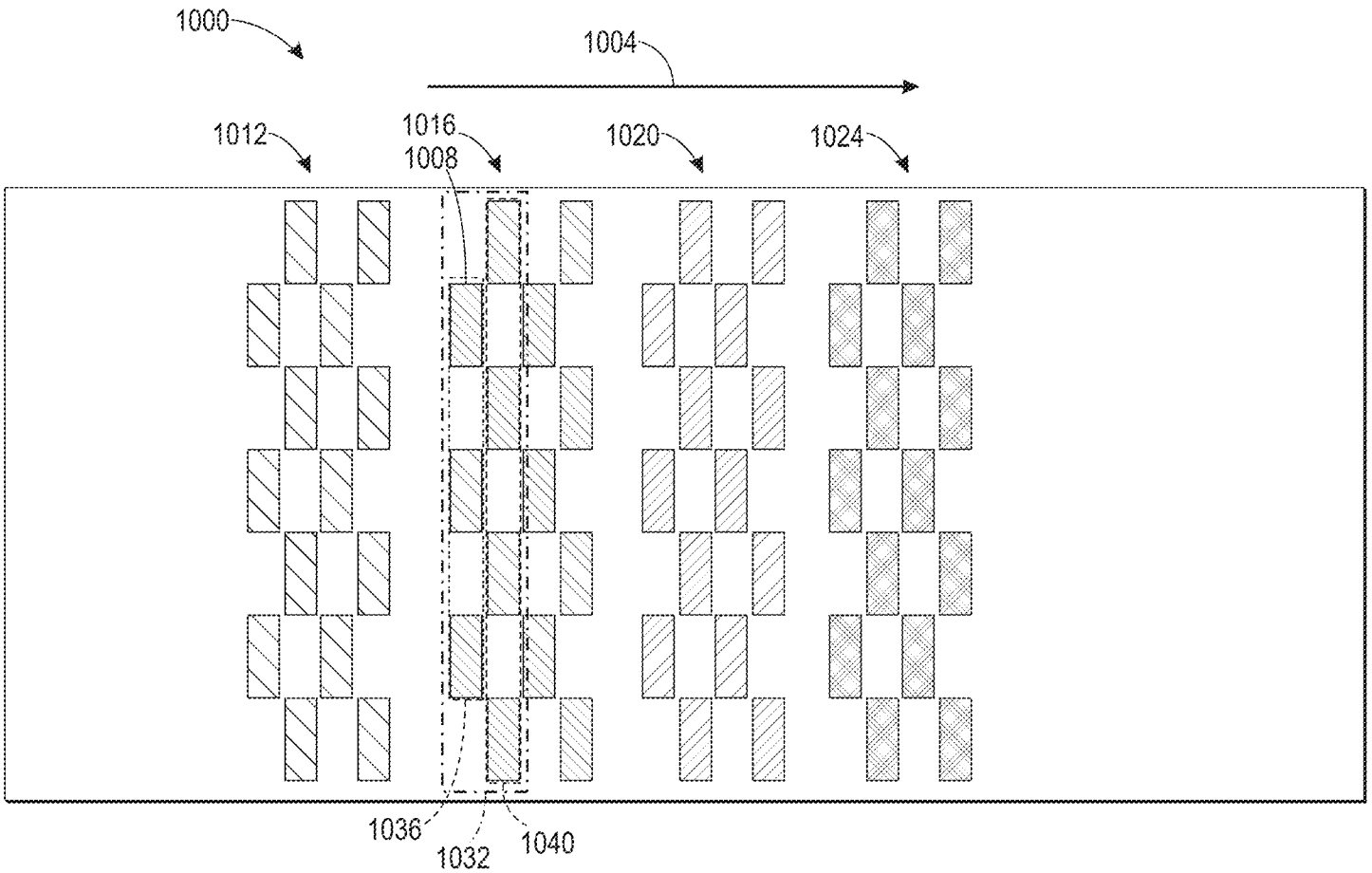
FIG. 8 PRIOR ART
FIG. 8 is a schematic view of a prior art printhead configuration.

A schematic view of a prior art print zone 1000 that can be used in the system 110 is shown in FIG. 8. The print zone 1000 includes four color units 1012, 1016, 1020, and 1024 arranged along a process direction 1004. Each color unit ejects ink of a color that is different than the other color units. In one embodiment, color unit 1012 ejects cyan ink, color unit 1016 ejects magenta ink, color unit 1020 ejects yellow ink, and color unit 1024 ejects black ink. The process direction is the direction that an image receiving member moves as travels under the color unit from color unit 1012 to color unit 1024. Each color unit includes two print arrays, which include two print bars each that carry multiple printheads. For example, the printhead array 1032 of the magenta color unit 1016 includes two print bars 1036 and 1040. Each print bar carries a plurality of printheads, as exemplified by printhead 1008. Print bar 1036 has three printheads, while print bar 1040 has four printheads, but alternative print bars can employ a greater or lesser number of printheads. The printheads on the print bars within a print array, such as the printheads on the print bars 1036 and 1040, are staggered to provide printing across the image receiving member at a first resolution. The printheads on the print bars with the print array 1034 within color unit 1016 are interlaced with reference to the printheads in the print array 1032 to enable printing in the colored ink across the image receiving member in the cross process direction at a second resolution. The print bars and print arrays of each color unit are arranged in this manner. One printhead array in each color unit is aligned with one of the printhead arrays in each of the other color units. The other printhead arrays in the color units are similarly aligned with one another. Thus, the aligned printhead arrays enable drop-on-drop printing of different primary colors to produce secondary colors. The interlaced printheads also enable side-by-side ink drops of different colors to extend the color gamut and hues available with the printer.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of operating an inkjet printer comprising:

operating at least one printhead to form a test pattern having a plurality of dashes on an image receiving member, the at least one printhead being operated to form a single dash in the plurality of dashes with each inkjet in the at least one printhead, each dash in the plurality of dashes being formed with a plurality of ink drops ejected from each inkjet in the at least one printhead so each dash extends a distance in a process direction that is greater than a length of a single scanline in the process direction that is produced by a plurality of optical detectors extending in a cross-process direction across the image receiving member and each dash is formed with only one inkjet in the at least one printhead;

generating image data of the test pattern on the image receiving member; and analyzing the generated image data by identifying an area of each dash in the plurality of dashes and identifying an inkjet as a split inkjet when the identified area of the dash formed in the plurality of dashes by the inkjet is larger than the identified area of the dash formed in the plurality of dashes by a normal inkjet in the at least one printhead.

2. The method of claim 1 further comprising:

adjusting at least one firing signal parameter for each split inkjet identified in the at least one printhead.

3. The method of claim 2 wherein the at least one firing signal parameter adjusted is a peak voltage.

4. The method of claim 3 wherein the peak voltage is increased.

5. The method of claim 2, the identification of the split inkjet further comprising:

detecting that the identified area of the dash formed by the split inkjet is 1.5 times the standard deviation of an average area of the dashes in the plurality of dashes formed by the normal inkjets in the at least one printhead.

6. The method of claim 5 further comprising:

generating firing signals for operating the split inkjets using the at least one firing signal parameter adjusted for each split inkjet.

7. The method of claim 6 further comprising:

generating image data of the ink drops ejected by the split inkjets onto the image receiving member to form additional dashes on the image receiving member after the analyzing the generated image of the ink drops ejected by the split inkjets to form the additional dashes on the image receiving member; and identifying the split inkjets that have been remediated in response to an area of at least one of the additional dashes being less than 1.5 times the standard deviation of an average area of the dashes in the plurality of dashes formed by the normal inkjets in the at least one printhead.

8. The method of claim 7 further comprising:

returning the at least one adjusted firing signal parameter for the split inkjets identified as being remediated to a nominal value.

9. An inkjet printer comprising:

at least one printhead having a plurality of inkjets;

a plurality of optical detectors that extend in a cross-process direction across a surface of an ink receiving member moving past the at least one printhead, the plurality of optical detectors being configured to generate a scanline of data of the surface of the ink receiving member; and a controller operatively connected to the at least one printhead and the plurality of optical detectors, the controller configured to:

operate each inkjet in the at least one printhead to eject a plurality of ink drops onto the ink receiving member as the ink receiving member moves in a process direction to form a single dash in a test pattern having a plurality of dashes on the image receiving member in the inkjet printer so each dash in the plurality of dashes extends in the process direction by a distance that is greater than a length in the process direction of the scanline produced by the plurality of optical detectors;

receive image data generated by the plurality of optical detectors of the plurality of dashes in the test pattern on the image receiving member;

identify an area of each dash in the image data of the plurality of dashes; and identify an inkjet as a split inkjet when the identified area of the dash formed by the inkjet is larger than the identified area of the dash formed by a normal inkjet in the at least one printhead.

10. The inkjet printer of claim 9, the controller being further configured to:

adjust at least one firing signal parameter for each split inkjet identified in the at least one printhead.

11. The inkjet printer of claim 10, the controller being further configured to:

adjust a peak voltage as the adjusted at least one firing signal parameter.

12. The inkjet printer of claim 11, the controller being further configured to:

increase the peak voltage.

13. The inkjet printer of claim 10, the controller being further configured to:

detect that the identified area of the dash formed by the split inkjet is 1.5 times the standard deviation of an average area of the dashes formed in the plurality of dashes by the normal inkjets in the at least one printhead.

14. The inkjet printer of claim 13 further comprising:

generate firing signals for operating the split inkjets using the at least one firing signal parameter adjusted for each split inkjet.

15. The inkjet printer of claim 14, the controller being further configured to:

receive image data generated by the plurality of optical detectors of ink drops ejected by the split inkjets onto the image receiving member to form additional dashes on the image receiving member after the split inkjets have been operated with the generated firing signals;

analyze the generated image of the ink ejected by the split inkjets; and identify the split inkjets that have been remediated in response to an area of at lest one of the additional dashes being less than 1.5 times the standard deviation of an average area of the dashes in the plurality of dashes formed by the normal inkjets in the at least one printhead.

16. The inkjet printer of claim 15, the controller being further configured to:

return the at least one adjusted firing signal parameter for the split inkjet identified as being remediated to a nominal value.

17. A method of operating an inkjet printer comprising:

operating at least one printhead to form a test pattern having a plurality of dashes on an image receiving member, the at least one printhead being operated to form a single dash in the plurality of dashes with each inkjet in the at least one printhead, each dash in the plurality of dashes having a length in the process direction that is longer than a length of a scanline in the process direction that is generated by a plurality of optical detectors that extend in a cross-process direction across the image receiving member;

generating with the plurality of optical detectors image data of the test pattern on the image receiving member; and identifying an area of each dash in the plurality of dashes; and identifying an inkjet as a split inkjet when the identified area of the dash formed in the plurality of dashes by the inkjet is larger than the identified area of the dash formed in the plurality of dashes by a normal inkjet in the at least one printhead.

18. The method of claim 17, the identification of the split inkjet further comprising:

detecting the identified area of the dash formed by the split inkjet is 1.5 times the standard deviation of an average area of the dashes formed in the plurality of dashes by the normal inkjets in the at least one printhead.

19. The method of claim 18 further comprising:

generating image data of ink drops ejected by the split inkjets to form additional dashes on the image receiving member after the split inkjets have been operated with firing signals having at least one firing signal parameter adjusted from a nominal value;

analyzing the generated image data of the additional dashes formed by the split inkjets using the firing signals having the at least one adjusted firing signal parameter; and identifying the split inkjets that have been remediated in response to an area of at least one of the additional dashes being less than 1.5 times the standard deviation of an average area of the dashes in the plurality of dashes formed by the normal inkjets in the at least one printhead.

20. The method of claim 19 further comprising:

returning the at least one adjusted firing signal parameter for the split inkjet identified as being remediated to the nominal value.

* * * * *